US011789400B2

(12) United States Patent
Tanaka et al.

(10) Patent No.: US 11,789,400 B2
(45) Date of Patent: Oct. 17, 2023

(54) IMAGE FORMING APPARATUS PROVIDED WITH HIGH VOLTAGE POWER SOURCE

(71) Applicant: BROTHER KOGYO KABUSHIKI KAISHA, Nagoya (JP)

(72) Inventors: Nobuyuki Tanaka, Konan (JP); Yoshiyuki Tsujimoto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 11 days.

(21) Appl. No.: 17/536,361

(22) Filed: Nov. 29, 2021

(65) Prior Publication Data

US 2022/0171322 A1 Jun. 2, 2022

(30) Foreign Application Priority Data

Nov. 30, 2020 (JP) ..... 2020-198913

(51) Int. Cl.
*G03G 15/00* (2006.01)
*G03G 21/16* (2006.01)

(52) U.S. Cl.
CPC ..... *G03G 15/80* (2013.01); *G03G 21/1652* (2013.01)

(58) Field of Classification Search
USPC ..... 399/88
See application file for complete search history.

(56) References Cited

U.S. PATENT DOCUMENTS

2010/0272463 A1* 10/2010 Inukai ..... G03G 15/80 399/88
2012/0104866 A1* 5/2012 Yoo ..... G03G 15/5004 307/86
2014/0293659 A1* 10/2014 Kosaka ..... G03G 15/1675 399/88

FOREIGN PATENT DOCUMENTS

JP H05-64442 A 3/1993
JP 2010-256804 A 11/2010
JP 2013-160853 A 8/2013
JP 2018-183950 A 11/2018

* cited by examiner

*Primary Examiner* — Quana Grainger
(74) *Attorney, Agent, or Firm* — Scully, Scott, Murphy & Presser, P.C.

(57) ABSTRACT

An image forming apparatus includes a print engine which forms an image on a sheet; a high voltage power source substrate which applies output voltage to the print engine and which has a high voltage generating circuit for generating a high voltage by boosting inputted low voltage and a high voltage maintaining circuit for maintaining the high voltage at a predetermined value, the high voltage maintaining circuit being driven by the inputted low voltage; a low voltage power source which inputs the low voltage to the high voltage generating circuit and the high voltage maintaining circuit; and an ON/OFF circuit which switches whether or not the low voltage is inputted from the low voltage power source to the high voltage generating circuit and the high voltage maintaining circuit.

4 Claims, 5 Drawing Sheets

FIG. 4

| OPEN/CLOSED SENSOR | INTERLOCK SWITCH | ENABLE/ DISENABLE | LOW VOLTAGE SUPPLY LINE PL |
|---|---|---|---|
| High | Open | Disenable(=Low) | 0V |
| High | | Enable(=High) | 0V |
| Low | Closed | Disenable(=Low) | 0V |
| Low | | Enable(=High) | 24V |

IMAGE FORMING APPARATUS PROVIDED WITH HIGH VOLTAGE POWER SOURCE

CROSS REFERENCE TO RELATED APPLICATIONS

The present application claims priority from Japanese Patent Application No. 2020-198913, filed Nov. 30, 2020, the disclosure of which is incorporated herein by reference in its entirety.

BACKGROUND

The present teaching relates to an image forming apparatus.

An image forming apparatus has a high voltage generating power source which supplies a high voltage, for example, to a charger and a transfer roller. In view of the electric power saving, the high voltage generating power source of the image forming apparatus stops the supply of the high voltage having been supplied, for example, to the charger and the transfer roller.

Conventionally, an image forming apparatus is known, in which a high voltage generating power source is provided with a low voltage power source cutoff unit. When an opening/closing cover of the image forming apparatus is opened, an interlock switch, which is interlocked with the opening of the opening/closing cover, cuts off a first low voltage line. A first low voltage is not supplied to the low voltage power source cutoff unit on account of the cutoff of the first low voltage line. The low voltage power source cutoff unit cuts off the supply of a second low voltage from a second low voltage power source to a second reference voltage generating unit.

The conventional image forming apparatus has a high voltage generating circuit which boosts the inputted voltage and which supplies the high voltage as the boosted voltage to a print engine, and a high voltage maintaining circuit which maintains the high voltage at a predetermined value. When the mode is transferred to the electric power saving mode, the conventional image forming apparatus stops the supply of the high voltage to the print engine by cutting off the driving voltage with respect to the high voltage maintaining circuit.

SUMMARY

However, the conventional image forming apparatus has the following problem. That is, when the mode is transferred to the electric power saving mode, then the voltage inputted into the high voltage generating circuit is continuously supplied, and a weak current continuously flows through a transformer of the high voltage generating circuit on account of the supply of the voltage An object of the present teaching is to provide an image forming apparatus which is adapted to more enhanced electric power saving.

According to an aspect of the present teaching, there is provided an image forming apparatus including:

a print engine configured to form an image on a sheet;

a high voltage power source substrate configured to apply output voltage to the print engine, and having: a high voltage generating circuit configured to generate high voltage by boosting inputted low voltage; and a high voltage maintaining circuit configured to maintain the high voltage at a predetermined value, the high voltage maintaining circuit being driven by the inputted low voltage;

a low voltage power source configured to input the low voltage to the high voltage generating circuit and the high voltage maintaining circuit; and an ON/OFF circuit configured to switch whether or not the low voltage is inputted from the low voltage power source to the high voltage generating circuit and the high voltage maintaining circuit.

According to the image forming apparatus configured as described above, the ON/OFF circuit switches whether or not the low voltage is inputted into the high voltage maintaining circuit and the high voltage generating circuit. Accordingly, the ON/OFF circuit can stop the driving of the high voltage maintaining circuit, and the ON/OFF circuit can cut off the weak current flowing through the high voltage generating circuit.

Further, the image forming apparatus according to the aspect of the present teaching may further include a control substrate on which a controller and the ON/OFF circuit are arranged, wherein under a condition that first signal is transmitted from the controller to the ON/OFF circuit, the ON/OFF circuit may be configured to apply the low voltage to the high voltage generate circuit and the high voltage maintaining circuit, and under a condition that second signal is transmitted from the controller to the ON/OFT circuit, the ON/OFF circuit may be configured not to input the low voltage to the high voltage generating circuit and the high voltage maintaining circuit.

According to the image forming apparatus configured as described above, the controller can allow the ON/OFF circuit to switch whether or not the low voltage is inputted to the high voltage generating circuit and the high voltage maintaining circuit, by transmitting the first signal and the second signal to the ON/OFF circuit.

Further, according to the image forming apparatus configured as described above, the ON/OFF circuit is arranged on the control substrate, and hence one wiring is provided between the control substrate and the high voltage power source substrate. That is, this one wiring is the voltage line for inputting the low voltage from the ON/OFF circuit into the high voltage power source substrate.

Further, the image forming apparatus according to the aspect of the present teaching may further include a control substrate on which a controller is arranged, wherein the ON/OFF circuit may be arranged on the high voltage power source substrate, under a condition that first signal is transmitted from the controller to the ON/OFF circuit, the ON/OFF circuit may be configured to input the low voltage to the high voltage generating circuit and the high voltage maintaining circuit, and under a condition that second signal is transmitted from the controller to the ON/OFF circuit, the ON/OFF circuit may be configured not to input the low voltage to the high voltage generating circuit and the high voltage maintaining circuit.

According to the image forming apparatus configured as described above, the controller can allow the ON/OFF circuit to switch whether or not the low voltage is inputted to the high voltage generating circuit and the high voltage maintaining circuit, by transmitting the first signal and the second signal to the ON/OFF circuit.

Further, according to the image forming apparatus configured as described above, the ON/OFF circuit is arranged on the high voltage power source substrate, and hence two wirings are provided between the control substrate and the high voltage power source substrate. That is, these two wirings are the communication line for transmitting the first signal and the second signal from the controller to the ON/OFF circuit and the voltage line for inputting the low voltage into the ON/OFF circuit.

Further, the image forming apparatus according to the aspect of the present teaching may further include an interlock switch configured to be opened while being interlocked with opening of a cover of the image forming apparatus, wherein under a condition that the interlock switch is open, the ON/OFF circuit may be configured not to input the low voltage to the high voltage generating circuit and the high voltage maintaining circuit regardless of transmission of the first signal and the second signal from the controller.

According to the image forming apparatus configured as described above, if the cover of the image forming apparatus is opened, the interlock switch is opened. In this case, the ON/OFF circuit stops the input of the low voltage to the high voltage maintaining circuit and the high voltage generating circuit, irrelevant to the presence or absence of the transmission of the first signal or the second signal from the controller. Therefore, when the cover of the image forming apparatus is opened, it is possible to reliably stop the input of the low voltage to the high voltage generating circuit and the high voltage maintaining circuit.

According to the aspect of the present teaching, it is possible to provide the image forming apparatus which is adapted to more enhanced electric power saving.

BRIEF DESCRIPTION OF THE DRAWINGS

FIG. 4 is an exemplary operation of the ON/OFF circuit according to the first embodiment.

DETAILED DESCRIPTION

First Embodiment

An embodiment of the present teaching will be explained below with reference to the drawings. An image forming apparatus 10 according to a first embodiment is an apparatus for forming an image on a sheet.

<Overall Configuration of Image Forming Apparatus 10>

Figure 1:
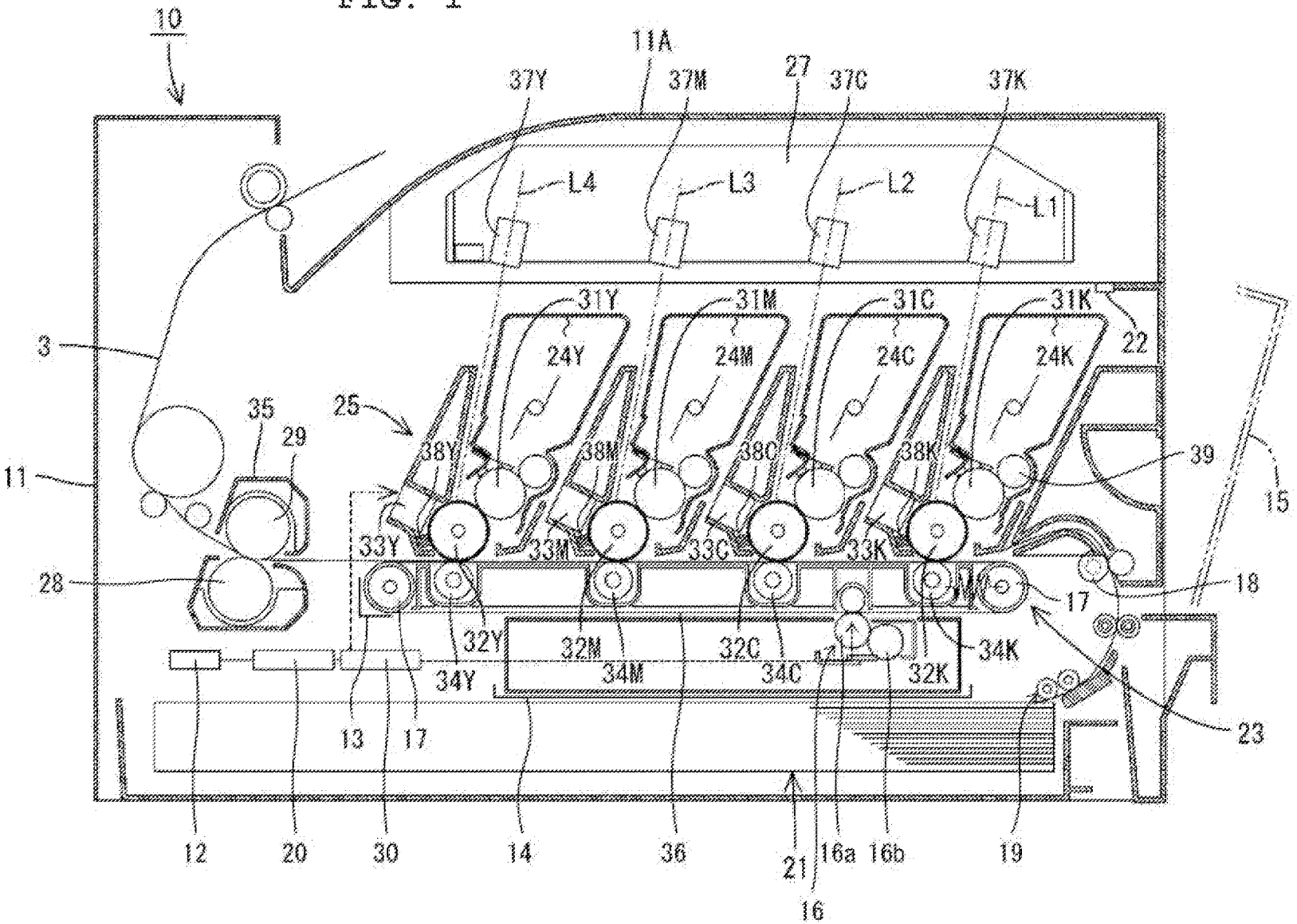
FIG. 1 is a schematic sectional view illustrative of an internal structure of an image forming apparatus according to a first embodiment.

FIG. 1 is a schematic sectional view illustrative of an internal structure of the image forming apparatus 10 according to the first embodiment. Note that in the following explanation, the right side as viewed in FIG. 1 is designated as the frontward of the image forming apparatus. Further, the image forming apparatus 10 is an LED color printer for forming an color image by using four color (black K, yellow Y, magenta M, cyan C) coloring agents. In the following description, when respective constitutive parts are distinguished in relation to the respective colors, K (black), Y (yellow), M (magenta), or C (cyan), which means each of the colors, is affixed to the end of the reference numeral of the constitutive part. Further, the image forming apparatus 10 is not limited to the LED color printer. The image forming apparatus 10 may be, for example, a laser color printer, a facsimile apparatus, or a so-called multifunction machine provided with, for example, the printer function and the reading function (scanner function).

The image forming apparatus 10 is provided with a main body casing 11. A paper feed tray 21, on which sheets of printing paper 3 as an example of the sheet are stacked, is provided at the bottom of the main body casing 11. Further, an access port, which is usable to access a print engine 25 described later on, is formed on the front surface of the main body casing 11. A front cover 15 is installed at the access port so that the front cover 15 can be rotatably operated. The front cover 15 is an example of the cover, The access port can be closed or opened by the front cover 15. Further, an open/closed sensor 22 is arranged adjacently to the front cover 15. The open/closed sensor 22 generates a detection signal corresponding to the open/closed state of the front cover 15. The detection signal is supplied to a high voltage power source substrate 30.

A paper feed roller 19 is provided over or above the front end of the paper feed tray 21. The printing paper 3 disposed at the uppermost position, which is accumulated in the paper feed tray 21, is fed to a registration roller 18 in accordance with the rotation of the paper feed roller 19. For example, after the oblique travel of the printing paper 3 is corrected, the registration roller 18 conveys the printing paper 3 onto a belt unit 23 of the print engine 25.

The print engine 25, which concerns the image formation, is provided with, for example, the belt unit 23, an exposure unit 27, process cartridges 24, developing rollers 31, photosensitive drums 32, transfer rollers 34, a fixing unit 35, and a belt cleaning device 16.

The belt unit 23 is provided with a pair of front and back belt support rollers 17 and a belt 36. When the back belt support roller 17 is driven and rotated, then the belt 36 is moved thereby in a circulating manner counterclockwise as viewed on the basis of the paper surface, and the printing paper 3, which is disposed on the upper surface of the belt 36, is conveyed backwardly. Further, the transfer roller 34 is provided at the inside of the belt 36 at a position opposed to the photosensitive drum 32 with the belt 36 intervening therebetween. The belt unit 23 has TRCC1 terminal to TRCC4 terminal to receive transfer voltages TRCC1 to TRCC4 (output voltages) applied to the respective transfer rollers 34. The belt unit 23 is installed to a belt unit installing unit 13 which is installed on an unillustrated main body frame. The belt unit installing unit 13 has unillustrated respective electrode terminals which are provided at positions corresponding to the respective TRCC1 terminal to TRCC4 terminal. Each of the electrode terminals is connected to a corresponding transfer voltage generating circuit of transfer voltage generating circuits 70K to 70C via an unillustrated voltage application line.

The exposure unit 27 is provided with four LED units 37 which correspond to the respective colors. Unillustrated respective light-emitting units are subjected to the light emission control on the basis of image data of an image to be formed. Accordingly, the lights L1 to L4, which are emitted from the respective light-emitting units, are radiated onto the surfaces of the photosensitive drums 32, and the surfaces are subjected to the exposure.

The print engine 25 is provided with the process cartridges 24 which correspond to the four colors described above. The process cartridges 24 include a monochrome cartridge 24K and color cartridges 24Y, 24M, 24C.

The monochrome cartridge 24K is provided with the photosensitive drum 32 which is a high resistor and which has a surface covered with a photosensitive layer of the positive charge type, a charger 33, a drum cleaning roller 38, an unillustrated drum cleaning shaft, and an unillustrated development cartridge.

A roller voltage DCLNA, which is a high voltage, is applied to the drum cleaning roller 38. The toner, which remains on the photosensitive drum 32, is recovered by the application of the roller voltage DCLNA.

Further, the drum cleaning shaft is composed of a conductive metal. The paper powder, which remains on the drum cleaning roller 38, is removed by the application of a shaft voltage DCLNB which is a voltage higher than the roller voltage DCLNA. That is, the cleaning shaft removes the paper powder with which the interior of the main body casing 11 is contaminated, by utilizing the shaft voltage DCLNB.

Usually, the toner is charged to have the positive polarity, and the paper powder is charged to have the negative polarity. Therefore, the toner and the paper powder are individually removed from the surface of the photosensitive drum 32 by utilizing the difference in the charge polarity. Only the toner is recovered from the surface of the photosensitive drum 32 to the surface of the drum cleaning roller 38 by applying the negative voltage, for example, the roller voltage DCLNA of −400 V to the drum cleaning roller 38 during the printing. Then, during the printing, the positive voltage, for example, the roller voltage DCLNA of 600 V is applied to the drum cleaning roller 38, and the shaft voltage DCLNA of 700 V is applied to the drum cleaning shaft. In this situation, the paper powder is recovered to the drum cleaning shaft by the aid of the drum cleaning roller 38. The toner is discharged onto the photosensitive drum 32. After that, the toner adheres to the surface of the belt 36, and the toner is recovered by the belt cleaning device 16.

The belt cleaning device 16 is provided with a belt cleaning roller 16*a* and a belt cleaning shaft 16*b*. The toner, which is adhered to the surface of the belt 36, is recovered by the aid of the belt cleaning roller 16*a* and the belt cleaning shaft 16*b* by applying the belt cleaning roller voltage BCLN (output voltage) to the belt cleaning roller 16*a*. The belt cleaning device 16 has a BCLN terminal for receiving the belt cleaning roller voltage BCLN. The belt cleaning device 16 is installed to a cleaning device installing unit 14 installed on the unillustrated main body frame.

Further, the monochrome cartridge 24K has a CHG terminal for receiving the charging voltage CHG (output voltage), a GRID terminal for receiving the grid voltage GRID, a DEV terminal for receiving the development bias DEV, a DCLNA terminal for receiving the roller voltage DCLNA, and a DCLNB terminal for receiving the shaft voltage DCLNB.

On the other hand, each of the color cartridges 24Y, 24M, 24C is provided with a photosensitive drum 32, a charger 33, a drum cleaning roller 38, and an unillustrated development cartridge in the same manner as described above.

Further, each of the color cartridges 24Y, 24M, 24C has a CHG terminal, a GRID terminal, a DEV terminal, and a DCLNA terminal.

Each of the development cartridges is provided with an unillustrated toner accommodating chamber for accommodating the toner as the developing agent, a supply roller 29, and a developing roller 31 at an upper portion at the inside of the box-shaped main body casing 11.

The toner, which is released from the toner accommodating chamber, is supplied to the developing roller 31 in accordance with the rotation of the supply roller 39, and the toner is frictionally charged to have the positive polarity between the supply roller 39 and the developing roller 31. Further, the toner, which is supplied to the surface of the developing roller 31, is sufficiently charged in accordance with the application of the development bias DEV, and the toner is carried on the surface of the developing roller 31 as a thin layer having a constant thickness.

During the image formation, the photosensitive drum 32 is driven and rotated. In accordance therewith, the surface of the photosensitive drum 32 is positively charged uniformly by means of the charger 33. Then, the positively charged portion is subjected to the exposure by means of the high speed scanning with the light radiated from the LED unit 37. An electrostatic latent image, which corresponds to the image to be formed on the printing paper 3, is formed on the surface of the photosensitive drum 32.

Subsequently, when the toner, which is carried on the developing roller 31 and which is positively charged, is brought in contact with the photosensitive drum 32 while being opposed thereto in accordance with the rotation of the developing roller 31, the toner is supplied to the electrostatic latent image which is formed on the surface of the photosensitive drum 32. Accordingly, the electrostatic latent image on the photosensitive drum 32 is converted into a visible image, and the toner image, in which the toner adheres to only the exposed portion, is carried on the surface of the photosensitive drum 32.

After that, the toner image, which is carried on the surface of each of the photosensitive drums 32, is successively transferred to the printing paper 3 by means of the transfer voltage TRCC having the negative polarity applied to the transfer roller 34 during the period in which the printing paper 3 conveyed by the belt 36 passes through each of the transfer positions between the photosensitive drum 32 and the transfer roller 34. The printing paper 3, to which the toner image has been transferred as described above, is subsequently conveyed to the fixing unit 35.

The fixing unit 35 is provided with a heating roller 29 which has a heat source and a pressurizing roller 28 which presses the printing paper 3 against the heating roller 29 so that the toner image, which is transferred onto the printing paper 3, is thermally fixed to the paper surface. Then, the printing paper 3, which has been thermally fixed by the fixing unit 35, is conveyed upwardly. The printing paper 3 is discharged onto a paper discharge tray provided on an upper surface wall 11A of the main body casing 11.

Further, the high voltage power source substrate 30, the low voltage power source substrate 12, and the control substrate 20 for controlling the high voltage power source substrate 30 and the low voltage power source substrate 12 are provided in the main body casing 11.

<Configuration of High Voltage Power Source 100>

Next, an explanation will be made about the configuration of the high voltage power source 100 with reference to FIG. 2. The high voltage power source 100 generates a plurality of high voltages which are to be applied to respective electric loads provided for the image forming apparatus 10. The respective electric loads are, for example, the transfer roller 34, the belt cleaning roller 16*a*, the drum cleaning roller 38, the charger 33, and the developing roller 31.

The high voltage power source 100 is provided with the control substrate 20, the high voltage power source substrate 30, and the low voltage power source substrate 12. Further, the circuits, which correspond to the respective colors, are actually provided on the high voltage power source substrate 30. However, the respective circuits are configured approximately identically. Therefore, only the configuration, which corresponds to the single color, is depicted in FIG. 2.

Figure 2:
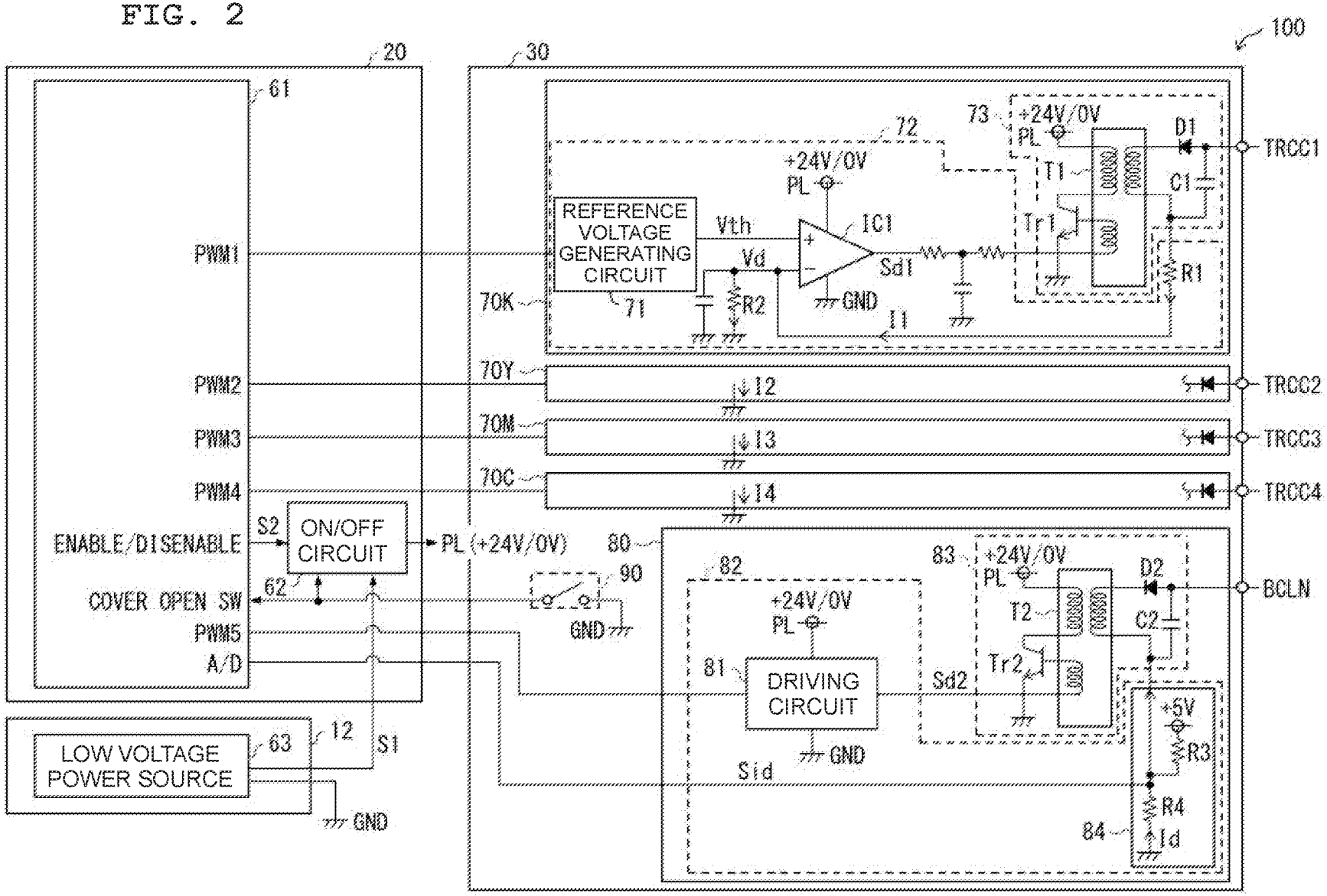
FIG. 2 is a schematic circuit diagram of a high voltage power source according to the first embodiment.

Note that as for the plurality of high voltages generated by the image forming apparatus 10, FIG. 2 depicts only transfer voltage generating circuits 70K to 70C for generating transfer voltages TRCC1 to TRCC4 applied to the respective transfer rollers 34K to 34C, and a belt cleaning voltage generating circuit 80 for generating a belt cleaning roller voltage BCLN applied to the belt cleaning roller 16*a*. Further, the transfer voltage generating circuits 70Y, 70M, 70C for the transfer rollers 34Y to 34C corresponding to the respective color cartridges 24Y, 24M, 24C are configured in the same manner as the transfer voltage generating circuit 70K for the transfer roller 34K corresponding to the monochrome cartridge 24K. Therefore, details of the internal configuration are omitted from FIG. 2, and any explanation thereof is omitted.

The control substrate 20 is provided with a controller 61 and an ON/OFF circuit 62. The high voltage power source substrate 30 is provided with the transfer voltage generating circuit 70K, the belt cleaning voltage generating circuit 80, and the interlock switch 90. The low voltage power source substrate 12 is provided with a low voltage power source 63.

The controller 61 controls the respective transfer voltage generating circuits 70K to 70C, the belt cleaning voltage generating circuit 80, and the ON/OFF circuit 62 in accordance with a predetermined process program stored in unillustrated ROM (Read Only Memory).

The ON/OFF circuit 62 is connected to an ENABLE/DISENABLE terminal of the controller 61 via a signal line S2. Further, the ON/OFF circuit 62 is connected to the low voltage power source 63 via a voltage line S1.

The ON/OFF circuit 62 performs the switching to decide whether or not the low voltage is inputted into a low voltage supply line PL as an output line of the ON/OFF circuit 62 on the basis of an ENABLE/DISENABLE signal supplied from the ENABLE/DISENABLE terminal of the controller 61. The ENABLE signal is an example of the first signal. The DISENABLE signal is an example of the second signal. In particular, if the ENABLE signal is inputted from the controller 61, the ON/OFF circuit 62 inputs the low voltage into the low voltage supply line PL. If the DISENABLE signal is inputted from the controller 61, the ON/OFF circuit 62 does not input the low voltage into the low voltage supply line PL.

The low voltage supply line PL inputs the low voltage into a high voltage maintaining circuit 72 and a high voltage generating circuit 73 of each of the transfer voltage generating circuits 70K to 70C arranged on the high voltage power source substrate 30. Further, the low voltage supply line PL inputs the low voltage into a high voltage maintaining circuit 82 and a high voltage generating circuit 83 of the belt cleaning voltage generating circuit 80. Note that the values of the low voltage inputted into the respective members arranged on the high voltage power source substrate 30 may be either identical with each other or different from each other.

The low voltage power source 63 supplies the low voltage to the ON/OFF circuit 62 via the voltage line S1. For example, in this embodiment, the low voltage is 24 V.

The interlock switch 90 is provided on the high voltage power source substrate 30. When the front cover 15 of the image forming apparatus 10 is opened, the open/closed sensor 22 depicted in FIG. 1 is operated. The open/closed sensor 22 is interlocked with the interlock switch 90. When the front cover 15 is opened, the interlock switch 90 is open while being interlocked with the operation of the open/closed sensor 22. On the other hand, when the front cover 15 is closed, the interlock switch 90 is closed while being interlocked with the operation of the open/closed sensor 22. One end of the interlock switch 90 is connected to the ON/OFF circuit 62 and the controller 61, and the other end of the interlock switch 90 is grounded to GND.

For example, the PWM signal, the ENABLE signal, and the DISENABLE signal are sent and received and the low voltage is supplied by means of the harness line among the control substrate 20, the low voltage power source substrate 12, and the high voltage power source substrate 30. In this embodiment, the ON/OFF circuit 62 is arranged on the control substrate 20. Therefore, only one low voltage supply line PL as the harness line is wired between the ON/OFF circuit 62 and the high voltage power source substrate 30.

In the following description, the transfer voltage generating circuit 70K of the respective transfer voltage generating circuits 70K to 70C will be representatively explained. The remaining respective transfer voltage generating circuits 70Y to 70C will be omitted because of the repetition of the same contents.

The transfer voltage generating circuit 70K is, for example, a self-excitation type high voltage generating circuit. The transfer voltage generating circuit 70K is configured by the high voltage maintaining circuit 72 and the high voltage generating circuit 73. The high voltage maintaining circuit 72 has a reference voltage generating circuit 71, an operational amplifier IC1, and voltage dividing resistors R1, R2. The high voltage generating circuit 73 has a transistor Tr1, a transformer T1, a diode D1, and a capacitor C1. The transfer voltage generating circuit 70K generates a transfer voltage TRCC1 to be supplied to the transfer roller 34K corresponding to the monochrome cartridge 24K. The transfer voltage TRCC1 is a high voltage having the negative polarity. Further, the transfer voltage generating circuit 70K is a voltage generating circuit having such hardware control configuration that any feedback in relation to the output is not effected with respect to the controller 61.

The reference voltage generating circuit 71 generates a reference voltage Vth in accordance with the PWM signal supplied from the PWM1 port of the controller 61. The reference voltage Vth is supplied to the non-inverting input of the operational amplifier IC1.

On the other hand, a divided voltage Vd, which is provided by the voltage dividing resistors R1, R2, is inputted into the inverting input of the operational amplifier IC1. The operational amplifier IC1 generates a driving signal Sd1 for driving the primary side of the transformer T1 on the basis of the reference voltage Vth and the divided voltage Vd. Further, the low voltage supply line PL is connected to the driving voltage input terminal of the operational amplifier IC1. One end of the voltage dividing resistor R1 is connected to one end of a secondary winding of the transformer T1, and the other end thereof is connected to the inverting input of the operational amplifier IC1. Further, one end of the voltage dividing resistor R2 is connected to the inverting input of the operational amplifier IC1, and the other end thereof is grounded to GND.

Further, one end of the primary winding of the transformer T1 is connected to the low voltage supply line PL, and the other end of the primary winding is connected to the collector of the transistor Tr1. The driving signal Sd1 is supplied to the base of the transistor Tr1. The base current of the transistor Tr1 is controlled by the driving signal Sd1, and thus the secondary voltage of the transformer T1, i.e., the transfer voltage TRCC1 is generated. In this process, the operational amplifier IC1 is operated so that the difference between the reference voltage Vth and the divided voltage Vd disappears. In accordance with this operation, the current I1, which flows through the voltage dividing resistors R1, R2, is maintained at a predetermined value. That is, the transfer current, which is brought about by the application of the transfer voltage TRCC1 to the transfer roller 34K, is maintained at a predetermined value.

The diode D1 and the capacitor C1 rectify and smooth the secondary voltage of the transformer T1 to generate the transfer voltage TRCC1 as a DC voltage.

In this case, the reference voltage generating circuit 71, the operational amplifier IC1, and the voltage dividing resistors R1, R2 configure the high voltage maintaining circuit 72. The transistor Tr1, the transformer T1, the diode D1, and the capacitor C1 configure the high voltage generating circuit 73. In this embodiment, the transfer voltage generating circuit 70K is subjected to the constant current control. Note that there is no limitation thereto. It is also allowable that the transfer voltage generating circuit 70K may be subjected to the constant voltage control.

In this case, the low voltage supply line PL of the ON/OFF circuit 62 is connected to the operational amplifier IC1 of the high voltage maintaining circuit 72 of the transfer voltage generating circuit 70K. When the ON/OFF circuit 62 does not input the low voltage, then the driving of the operational amplifier IC1 is stopped, and the driving signal Sd1 is not transmitted to the base of the transistor Tr1. As a result, the high voltage generating circuit 73 does not generate the transfer voltage TRCC1.

Further, the low voltage supply line PL is connected to one end of the transformer T1 of the high voltage generating circuit 73. When the ON/OFF circuit 62 does not input the low voltage, then the low voltage is not applied to one end of the transformer T1 as well, and any current does not flow through the transformer T1.

The belt cleaning voltage generating circuit 80 is, for example, a high voltage generating circuit of the self-excitation type in the same manner as the transfer voltage generating circuit 70K. The belt cleaning voltage generating circuit 80 includes a driving circuit 81, a transistor Tr2, a transformer T2, a diode D2, a capacitor C2, and a current detection circuit 84. The driving circuit 81 and the current detection circuit 84 configure the high voltage maintaining circuit 82, The transistor Tr2, the transformer T2, the diode D2, and the capacitor C2 configure the high voltage generating circuit 83. The belt cleaning voltage generating circuit 80 generates the belt cleaning voltage BCLN for the belt cleaning roller 16*a*. The belt cleaning voltage BCLN is a high voltage having the positive polarity. Further, the belt cleaning voltage generating circuit 80 is a voltage generating circuit of the software control configuration in which the feedback is effected in relation to the output with respect to the controller 61.

The driving circuit 81 generates a driving signal Sd2 in order to drive the primary side of the transformer T2 in accordance with a PWM signal supplied from a PWM5 port of the controller 61. Further, as for the driving circuit 81, the low voltage supply line PL is connected to a driving voltage input terminal.

Further, the low voltage supply line PL is connected to one end of a primary winding of the transformer T2. The driving signal Sd2 is supplied to the base of the transistor Tr2, and the base current of the transistor Tr2 is controlled by the driving signal Sd2. Thus, the secondary voltage of the transformer T2, i.e., the belt cleaning voltage BCLN is generated. In this process, the controller 61 controls the pulse width of the PWM signal on the basis of the current detection signal Sid supplied from the current detection circuit 84. Thus, the belt cleaning voltage generating circuit 80 is controlled so that the belt cleaning voltage BCLN or the belt cleaning current is constant.

The diode D2 and the capacitor C2 rectify and smooth the secondary voltage of the transformer T2 to generate the belt cleaning voltage BCLN.

The current detection circuit 84 includes a resistor R3 and a resistor R4. One end of the resistor R3 is connected to one end of a secondary winding of the transformer T2 and +5 V voltage. The other end thereof is connected to an A/D port of the controller and one end of the voltage dividing resistor R4. The other end of the resistor R4 is grounded to GND. The current detection signal Sid is a signal to detect the current Id flowing through the resistor R4, and the signal is inputted into the A/D port as the voltage value at the connection point between the resistor R3 and the resistor R4.

The controller 61 receives the current detection signal Sid from the current detection circuit 84. The controller 61 sends the PWM signal to the driving circuit 81 in order to allow the belt cleaning voltage generating circuit 80 to apply the belt cleaning voltage BCLN having a predetermined value to the belt cleaning roller 16*a* on the basis of the current detection signal Sid.

That is, the controller 61 receives the current detection signal Sid, and the controller 61 calculates the current value from the voltage value of the current detection signal Sid and the resistance value of the resistor R4. Then, the controller 61 controls the pulse width of the PWM signal on the basis of the current value so that the belt cleaning voltage BCLN has the predetermined value.

In this case, the low voltage supply line PL of the ON/OFF circuit 62 is connected to the driving circuit 81 of the high voltage maintaining circuit 82 of the belt cleaning voltage generating circuit 80. When the ON/OFF circuit 62 does not input the low voltage, then the driving circuit 81 stops the driving, and the driving signal Sd2 is not transmitted to the transformer T2. The high voltage generating circuit 83 cannot generate the belt cleaning voltage BCLN.

Then, the low voltage supply line PL is connected to one end of the transformer T2 of the high voltage generating circuit 83. When the ON/OFF circuit 62 does not input the low voltage, then the low voltage is not applied to one end of the transformer T2 as well, and no current flows through the transformer T2.

When the low voltage is not inputted into the respective high voltage maintaining circuits 72, 82 and the respective high voltage generating circuits 73, 83, the ON/OFF circuit 62 can stop the generation of the transfer voltage TRCC1 and the belt cleaning voltage BCLN at once.

<Circuit Diagram of ON/OFF Circuit 62>

Figure 3:
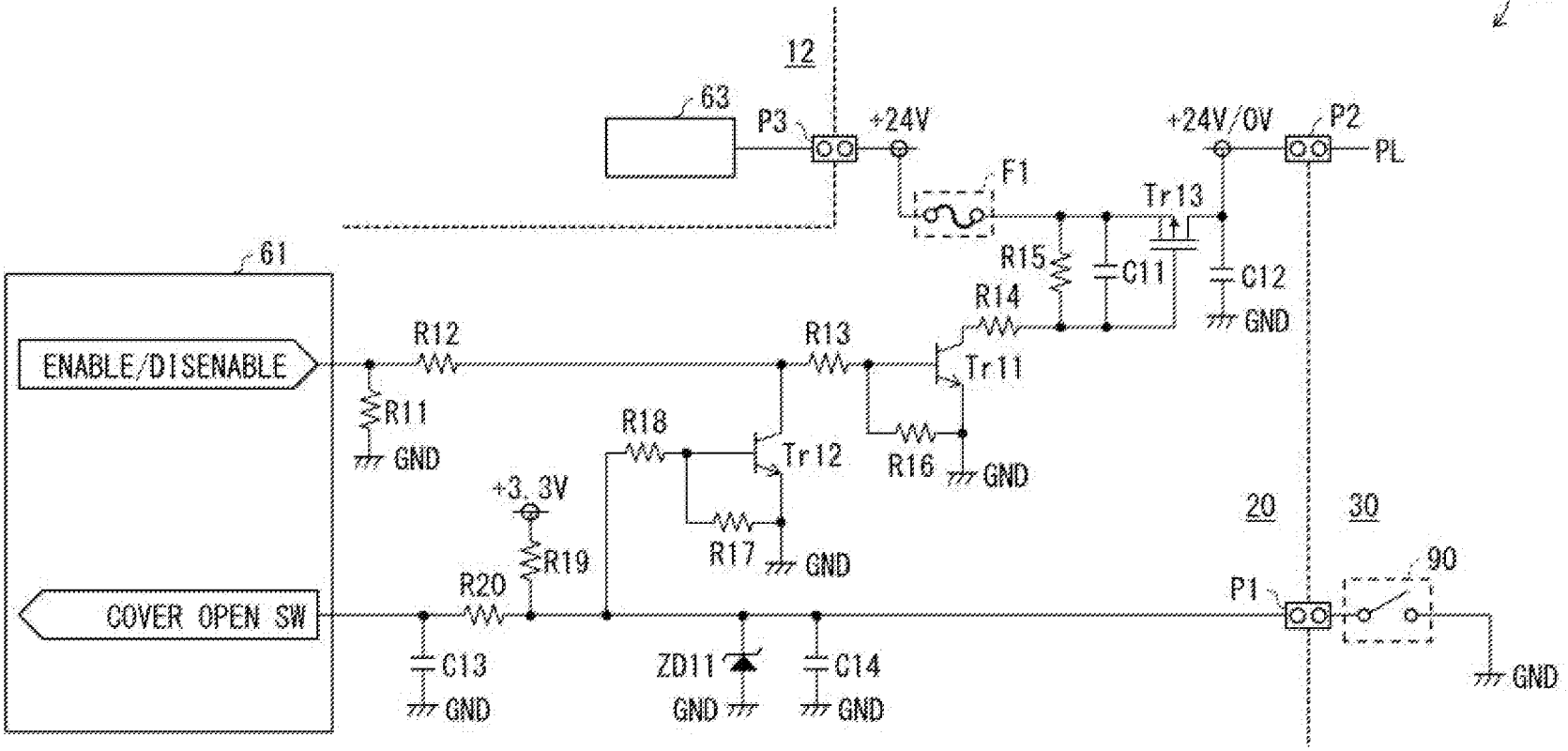
FIG. 3 is a circuit diagram of an ON/OFF circuit according to the first embodiment.

As depicted in FIG. 3, the ON/OFF circuit 62 is provided with resistors R11, R12, R13, R14, R15, R16, R17, R19, R20, transistors Tr11, Tr12, Tr13, capacitors C11, C12, C13, C14, a diode ZD11, and a fuse F1.

One end of the interlock switch 90 is connected to the terminal P1 of the ON/OFF circuit 62, and it is connected to a cover open switch terminal of the controller 61 via the resistor R19. Further, one end of the interlock switch 90 is connected to the base of the transistor Tr12 via the resistor R18. Then, one end of the interlock switch 90 is connected to the power source of 3.3 V via the resistor R19, it is connected to the cathode of the Zeiler diode ZD11, and it is connected to the capacitor C14. The other end of the interlock switch 90 is grounded to GND.

The ENABLE/DISENABLE terminal of the controller 61 is connected to the collector of the transistor Tr12 via the resistor R12 of the ON/OFF circuit 62, and it is connected to the base of the transistor Tr11 via the resistor R13.

The low voltage power source 63 is connected to the terminal P3 of the ON/OFF circuit 62. The terminal P3 is connected to the source of the transistor Tr13 via the fuse F1. Further, the terminal P3 is connected to the collector of the transistor Tr11 via the fuse F1, the resistor R15, and the resistor R14.

The drain of the transistor Tr13 is connected to the low voltage supply line PL, and the low voltage is inputted via the terminal P2 into the transfer voltage generating circuit 70K arranged on the high voltage power source substrate 30 and the belt cleaning voltage generating circuit 80.

An explanation will be made about the operation of the ON/OFF circuit 62 with reference to FIG. 4. When the front cover 15 is opened, the detection signal of the open/closed sensor 22 is at the High level. If the detection signal is at the High level, the interlock switch 90 is open. In this case, the ON/OFF circuit 62 does not input the low voltage even if the signal, which is transmitted from the ENABLE/DISENABLE terminal of the controller 61, is any one of the ENABLE signal and the DISENABLE signal. That is, the voltage of the low voltage supply line PL is 0 V.

In this way, in the state in which the front cover 15 is open, in view of the electric power saving, the ON/OFF circuit 62 stops the input of the low voltage into the transfer voltage generating circuit 70 and the belt cleaning voltage generating circuit 80. As a result, the transfer voltage generating circuit 70K and the belt cleaning voltage generating circuit 80 stop the generation of the high voltage.

On the other hand, when the front cover 15 is closed, the detection signal of the open/closed sensor 22 is at the Low level. If the detection signal is at the Low level, the interlock switch 90 is closed. In this case, the ON/OFF circuit 62 does not input the low voltage if the signal, which is transmitted from the ENABLE/DISENABLE terminal of the controller 61, is the DISENABLE signal. That is, the voltage of the low voltage supply line PL is 0 V. The ON/OFF circuit 62 inputs the low voltage if the signal, which is transmitted from the ENABLE/DISENABLE terminal of the controller 61, is the ENABLE signal. That is, the voltage of the low voltage supply line PL is 24 V.

In this way, in the state in which the front cover 15 is closed, the ON/OFF circuit 62 performs the switching to decide whether or not 24 V is inputted into the low voltage supply line PL on the basis of the ENABLE/DISENABLE signal of the controller 61.

The ON/OFF circuit 62 does not input the low voltage into the transfer voltage generating circuit 70K and the belt cleaning voltage generating circuit 80 connected to the low voltage supply line PL, and thus the ON/OFF circuit 62 stops the driving of the transfer voltage generating circuit 70K and the belt cleaning voltage generating circuit 80 to cut off the flow of the current through the high voltage generating circuits 73, 83. Accordingly, it is possible to realize the further enhanced electric power saving for the image forming apparatus 10.

Second Embodiment

Another embodiment of the present teaching will be explained below. Note that for the purpose of convenience of explanation, the members, which have the same functions as those of the members explained in the foregoing embodiment, are designated by the same reference numerals, any explanation of which will not be repeated.

Figure 5:
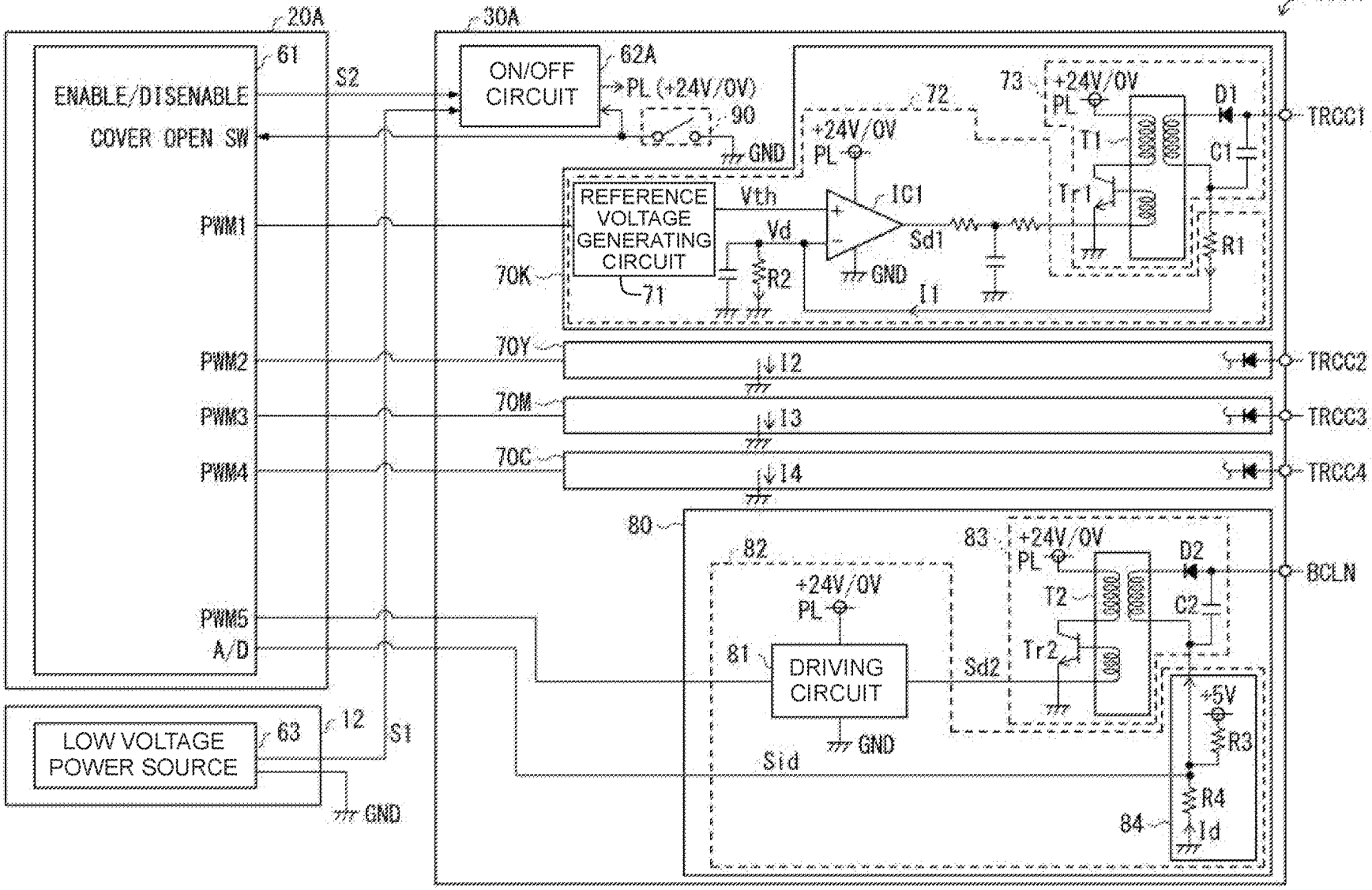
FIG. 5 is a schematic circuit diagram of a high voltage power source according to a second embodiment.

FIG. 5 depicts configuration of a high voltage power source 100A of an image forming apparatus 10 according to the second embodiment. The second embodiment is different from the first embodiment in that an ON/OFF circuit 62A is arranged on a high voltage power source substrate 30A. In the first embodiment, the ON/OFF circuit 62 is arranged on the control substrate 20, and hence the control substrate 20 and the high voltage power source substrate 30 are connected by the low voltage supply line PL provided therebetween.

In this embodiment, a voltage line S1 from the low voltage power source 63 and a signal line S2 from the controller 61 are connected to the ON/OFF circuit 62A. That is, two harness lines are connected to the high voltage power source substrate 30A.

The present teaching is not limited to the respective embodiments described above. Various changes or modifications can be made within a range as defined in claims. The technical scope of the present teaching also includes any embodiment which is obtained by appropriately combining the technical means disclosed in the different embodiments respectively.

What is claimed is:

1. An image forming apparatus comprising:

a print engine configured to form an image on a sheet;

a high voltage power source substrate configured to apply output voltage to the print engine, and having:

a high voltage generating circuit having a transformer and a rectification smoothing circuit, the transformer being configured to generate high voltage by boosting inputted low voltage, the rectification smoothing circuit being configured to generate the output voltage by rectifying and smoothing the high voltage; and a high voltage maintaining circuit configured to maintain the high voltage at a predetermined value, the high voltage maintaining circuit being driven by the inputted low voltage;

a low voltage power source configured to input the low voltage to the high voltage generating circuit and the high voltage maintaining circuit; and an ON/OFF circuit configured to switch whether or not the low voltage is inputted from the low voltage power source to the transformer and the high voltage maintaining circuit.

2. The image forming apparatus according to claim 1, further comprising a control substrate on which a controller and the ON/OFF circuit are arranged, wherein under a condition that a first signal is transmitted from the controller to the ON/OFF circuit, the ON/OFF circuit is configured to apply the low voltage to the transformer and the high voltage maintaining circuit, and under a condition that a second signal is transmitted from the controller to the ON/OFF circuit, the ON/OFF circuit is configured not to input the low voltage to the transformer and the high voltage maintaining circuit.

3. The image forming apparatus according to claim 1, further comprising a control substrate on which a controller is arranged, wherein the ON/OFF circuit is arranged on the high voltage power source substrate, under a condition that a first signal is transmitted from the controller to the ON/OFF circuit, the ON/OFF circuit is configured to input the low voltage to the transformer and the high voltage maintaining circuit, and under a condition that a second signal is transmitted from the controller to the ON/OFF circuit, the ON/OFF circuit is configured not to input the low voltage to the transformer and the high voltage maintaining circuit.

4. The image forming apparatus according to claim 2, further comprising an interlock switch configured to be opened while being interlocked with opening of a cover of the image forming apparatus, wherein under a condition that the interlock switch is open, the ON/OFF circuit is configured not to input the low voltage to the transformer and the high voltage maintaining circuit regardless of transmission of the first signal and the second signal from the controller.

* * * * *